US008573651B2

(12) United States Patent
Seki et al.

(10) Patent No.: US 8,573,651 B2
(45) Date of Patent: Nov. 5, 2013

(54) THREAD AND METHOD OF MANUFACTURING THE SAME, COUNTERFEIT PREVENTIVE PAPER USING THREAD, COUNTERFEIT PREVENTIVE PRINTED MATERIAL, AND METHOD OF JUDGING AUTHENTICITY UTILIZING THEM

(75) Inventors: Kanako Seki, Tokyo (JP); Makoto Maehira, Tokyo (JP); Toru Murakami, Tokyo (JP); Takashi Shimamura, Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 196 days.

(21) Appl. No.: 12/007,589

(22) Filed: Jan. 11, 2008

(65) Prior Publication Data

US 2008/0129036 A1 Jun. 5, 2008

Related U.S. Application Data

(63) Continuation of application No. PCT/JP2006/313855, filed on Jul. 12, 2006.

(30) Foreign Application Priority Data

Jul. 12, 2005 (JP) ..... 2005-202621

(51) Int. Cl.

| | |
|---|---|
| ***B42D 1/00*** | (2006.01) |
| ***B42D 19/00*** | (2006.01) |
| ***B42D 15/00*** | (2006.01) |
| ***B42D 15/10*** | (2006.01) |

(52) U.S. Cl.

USPC ..... 283/94; 281/2; 281/5; 283/57; 283/61; 283/62; 283/72; 283/114; 283/901

(58) Field of Classification Search

USPC ..... 281/2, 5; 283/57, 61, 62, 72, 94, 114, 283/117, 901

See application file for complete search history.

(56) References Cited

U.S. PATENT DOCUMENTS 4,462,866 A 7/1984 Tooth et al.
4,652,015 A * 3/1987 Crane ..... 283/901

(Continued)

FOREIGN PATENT DOCUMENTS

EP 0117478 A1 9/1984
EP 0695830 A1 2/1996

(Continued)

OTHER PUBLICATIONS

International Preliminary Report on Patentability issued in corresponding International Patent Application No. PCT/JP2006/313855, mailed on Jan. 24, 2008.

(Continued)

*Primary Examiner* — Dana Ross
*Assistant Examiner* — Justin V Lewis

(57) ABSTRACT

The invention provides a thread and counterfeit preventive paper satisfying the conditions that, when the micro-character of the thread is viewed from one side and opposite side of the paper or printed material, the image of micro-character can be recognized in the same direction from any side, not in opposite direction to each other, and that, when viewed from the opposite side, the image of the corresponding micro-character is not visible. The counterfeit preventive paper and counterfeit preventive printed material have a structure in which a thread having metal deposition layers formed in a pattern of micro-character and colored printed layers formed thereon provided on both sides of a strip-like and light permeable substrate is inserted between paper layers.

2 Claims, 6 Drawing Sheets

(56) References Cited

U.S. PATENT DOCUMENTS

| | | | | |
|---|---|---|---|---|
| 5,002,636 | A | 3/1991 | Crane | |
| 5,093,184 | A | 3/1992 | Edwards | |
| 5,176,405 | A * | 1/1993 | Kaule et al. | 283/72 |
| 5,565,276 | A | 10/1996 | Murakami et al. | |
| 6,549,131 | B1 * | 4/2003 | Cote et al. | 283/82 |
| 6,616,190 | B1 | 9/2003 | Jotcham | |
| 2002/0025418 | A1 | 2/2002 | Ishibashi et al. | |
| 2004/0233463 | A1 | 11/2004 | Hersch et al. | |
| 2005/0104364 | A1 * | 5/2005 | Keller et al. | 283/72 |
| 2006/0097512 | A1 * | 5/2006 | Isherwood | 283/72 |

FOREIGN PATENT DOCUMENTS

| | | | |
|---|---|---|---|
| GB | 2 213 098 | A | 8/1989 |
| GB | 2 250 473 | A | 6/1992 |
| JP | 51-130309 | | 11/1976 |
| JP | 2-169790 | | 6/1990 |
| JP | 5-40080 | | 6/1993 |
| JP | 5-85680 | | 12/1993 |
| JP | 6-62030 | | 3/1994 |
| JP | 6-272200 | | 9/1994 |
| JP | 7-207599 | | 8/1995 |
| JP | 7-243139 | | 9/1995 |
| JP | 10-100573 | | 4/1998 |
| JP | 10-226996 | | 8/1998 |
| JP | 10-251999 | | 9/1998 |
| JP | 3279212 | | 2/2002 |
| JP | 2002-264488 | | 9/2002 |
| JP | 2003-145951 | | 5/2003 |
| JP | 2005-36352 | | 2/2005 |
| WO | WO 94/24370 | | 10/1994 |
| WO | WO 03/061980 | A1 | 7/2003 |

OTHER PUBLICATIONS

Search Report issued by the European Patent Office on Apr. 26, 2012 in the corresponding European patent application.

International Search Report (PCT/ISA/210) mailed Oct. 24, 2006 in connection with the International Application PCT/JP2006/313865.

* cited by examiner

THREAD AND METHOD OF MANUFACTURING THE SAME, COUNTERFEIT PREVENTIVE PAPER USING THREAD, COUNTERFEIT PREVENTIVE PRINTED MATERIAL, AND METHOD OF JUDGING AUTHENTICITY UTILIZING THEM

CROSS REFERENCE TO RELATED APPLICATIONS

This is a Continuation Application of PCT Application No. PCT/JP2006/313855, filed Jul. 12, 2006, which was published under PCT Article 21(2) in Japanese.

This application is based upon and claims the benefit of priority from prior Japanese Patent Application No. 2005-202621, filed Jul. 12, 2005, the entire contents of which are incorporated herein by reference.

BACKGROUND OF THE INVENTION

1. Field of the Invention

The present invention relates to a thread preferably used in a field fighting against counterfeit (also known as strip, filament, string or safe strip) and a method of manufacturing the same, counterfeit preventive paper or threaded paper having the thread inserted therein, counterfeit preventive printed materials such as securities and banknotes utilizing them, and a method of judging authenticity of such counterfeit preventive paper or counterfeit preventive printed materials.

The thread is effective not only in the counterfeit preventive field but also in other aesthetic and design related fields, and is preferable, for example, in an apparel field for presenting products excellent in decorativeness. In the thread of the invention, in particular, a layer of a thin metal film is patterned according to a desired character or design, and it is one of the important elements for enhancing the effects in these fields. Considering the counterfeit preventive performance, generally, very small characters (so-called micro-characters) are widely used. In the invention, unless otherwise specified, micro-characters include both characters and patterns. A typical patterning technique of the metal thin film layer is so-called demetallizing process.

2. Description of the Related Art

The counterfeit preventive paper called "thread-inserted paper" having threads inserted in the paper layers is widely known. Since an extremely advanced technology is required in making threaded paper, such paper is highly effective for preventing counterfeit, and is employed in many nations for making banknotes.

The threaded paper is roughly classified into two types, and in one type the thread is inserted inside of the paper layers and not exposed to the paper surface, and in the other type the thread is partially exposed on the paper surface intermittently, which is known as "thread-inserted, window paper."

Following methods of making the former paper in which the thread is not exposed on the surface have been proposed: using a Fourdrinier paper machine, a nozzle is put into flow of paper stock in its slice section, the thread is let out while pouring water into the nozzle, and the thread is inserted into paper sheets formed in a manufacturing mesh (see, for example, patent document 1); a thread insertion device is disposed in the paper stock flowing out from the flow box of the Fourdrinier paper machine, and the thread is inserted while the thread is kept free from contact with the paper stock by an air stream (see, for example, patent document 2); and using a cylinder paper machine having two or more layers, two or more paper layers are made together, the thread is sent out between paper layers by using a feed tube having undulations in its inner wall, and the thread is inserted between the paper layers (see, for example, patent document 3).

Following methods of making the latter "windowed threaded paper" have been proposed: a belt mechanism having a thread groove at the leading end of a convex part of a guide having concave and convex parts is buried in paper stock suspended solution on a wire, and the threaded paper is made (see, for example, patent document 4); an undulated mesh is used as an upper mesh of a cylinder paper machine, the thread is inserted while contacting with concave and convex parts of the mesh surface, and the thread is inserted in the windowed portions (see, for example, patent document 5); and a compressed air nozzle is built in a rotary drum on the wire of the Fourdrinier paper machine, the slurry on the thread preliminarily inserted into the paper sheets is blown out intermittently by compressed air, and the thread is exposed (see, for example, patent document 6).

The "windowed threaded paper" is characterized by forming windowed portions by intermittently reducing the thickness in the paper feeding direction in which the thread is exposed in the windowed portions. Therefore, in the paper made by using the thread not coated with an adhesive on the surface, the thread may be easily peeled off if the thread exposed portion is rubbed with a nail, or the thread may be lifted at the time of printing, resulting in fatal defects. Accordingly, by making windowed threaded paper using the thread having a heat-sensitive adhesive on the surface thereof, and fusing or softening the heat-sensitive adhesive applied on the thread when drying the paper in a drying zone of the paper machine, the cellulose fibers composing the paper and the thread are adhered securely, thereby enhancing the strength against peeling.

Various types have been proposed for the thread to be used in the threaded paper. Practical examples include a hologram thread, a magnetic thread, a thread emitting fluorescent light by irradiation with ultraviolet ray, a thread coated with thermochromic agent, a metal deposited thread, and a thread with micro-characters.

Especially, the thread with micro-characters is known to be manufactured by following methods: a method of directly stamping foil on a plastic film; a method of selectively metallizing with a mask or template in a vacuum evaporation apparatus; and a method of metallizing and non-metallizing by corrosion (also known as paster processing or demetallizing process, which will be described later) (see, for example, patent document 7).

The thread having micro-characters by the "demetallizing process" is widely used in banknotes outside Japan. For example, in dollar banknotes of the United States and Euro banknotes of Europe, the threaded paper is used in which the thread is buried between paper layers, and in 100 Deutsche mark banknotes before introduction of Euro currency, the threaded paper was used in which the thread is intermittently exposed in the windowed portions. The micro-characters formed in these threads are alternately inverted between correct characters and inverted characters vertically from the viewpoint of correct direction of characters (in the invention, the characters are inverted laterally unless otherwise specified).

It means that the design allows the thread to be inverted when making paper. In other words, the thread is not distinguished whether it is obverse or reverse.

Meanwhile, the micro-character forming portion is formed of a metal vapor deposition layer (e.g. US dollar banknotes), or is formed of blanked characters (e.g. 100 Deutsche mark banknotes). In other words, the micro-characters are distinguished from positive type to negative type.

It is proposed to make counterfeit preventive paper by distinguishing obverse and reverse of the thread, and in the proposed counterfeit preventive paper having the thread inserted in the paper feeding direction, the thread includes a film as the base, micro-characters of correct characters only made of a metal vapor deposition layer formed on the surface of the film, a printed layer with transparent ink formed on the metal vapor deposition layer, and a thermosensitive adhesive layer formed on the reverse side of the film. The ink for forming the printed layer contains a dye pigment which develops color when irradiated with ultraviolet ray, and the thread is inserted in the paper so that the micro-character of correct character may be visible when viewed from the obverse side of the paper. In this counterfeit preventive paper in which the thread is formed in this manner, when the thread is irradiated with ultraviolet ray, by checking whether the printed layer of the thread develops color to be visible or not, the obverse and reverse sides of the thread can be distinguished easily. In this patent, the micro-character of the metal vapor deposition layer is obtained by the so-called "demetallizing process" (see, for example, patent document 8).

The prior-art documents are shown below.

Patent document 1: Jpn. Pat. Appln. KOKAI Publication No. 51-130309

Patent document 2: Jpn. Pat. Appln. KOKAI Publication No. 2-169790

Patent document 3: Jpn. Pat. Appln. KOKOKU Publication No. 5-40080

Patent document 4: Jpn. Pat. Appln. KOKOKU Publication No. 5-85680

Patent document 5: U.S. Pat. No. 4,462,866

Patent document 6: Jpn. Pat. Appln. KOKAI Publication No. 6-272200

Patent document 7: Jpn. Pat. Appln. KOKOKU Publication No. 6-062030 (column 5, line 46 to column 6, line 3; column 7, line 26 to column 8, line 12)

Patent document 8: Japanese Patent No. 3279212

BRIEF SUMMARY OF THE INVENTION

In the thread proposed in patent document 8, when made into the paper, as viewed from the obverse side of the paper, only the image of the micro-character on the obverse side of the thread is visible, and as viewed from the reverse side of the paper, the micro-character formed in the thread is seen as an inverted figure, laterally or vertically. In the merchandise certificates or stocks, generally, such thread does not necessarily lower the commercial value particularly. However, depending on the needs of the society or market (customers), if the paper or printed material is demanded to be handled same on obverse and reverse sides, for example, in the case of passport paper, it may be possibly desired that the image of micro-character of the thread should be seen in the same direction, whether viewed from the obverse side or reverse side of the paper (the correct direction as seen from obverse side and reverse side, or the inverted direction as seen from obverse side and reverse side).

Depending on other needs of the society or market (customers), it is often desired that the image of micro-character of the thread visible from the obverse side should not be visible (or hardly visible) from the reverse side. It is contrary to the expectation that something should be visible, and thus it may be expected to be useful as means for preventing counterfeit or an interesting idea for entertainment or plaything.

It is hence an object of the invention to provide a thread allowing the image of micro-character to be viewed in same direction, not in mutually opposite directions, when the micro-character of the thread is viewed from one side and opposite side of the paper or printed material, and not allowing (or hardly allowing) the image of micro-character to be seen when viewed from opposite side while the image of micro-character is viewed normally from one side of the paper or printed material, and also a method of manufacturing the same, a counterfeit preventive paper using this thread, a counterfeit preventive printed material, and a method judging authenticity utilizing the same counterfeit preventive paper or counterfeit preventive printed material.

In order to achieve the above object, the invention of claim 1 provides a thread comprising a string-like and light permeable substrate having front and back sides, at least one metal thin film layer formed in a pattern of either character or figure or both on one side of the substrate, and a colored resin layer patterned same as the metal thin film layer on the metal thin film layer, wherein, due to difference in light permeability between a region having the metal thin film layer and a region not having the metal thin film layer, a contrast is caused between the former region and the latter region when held to light, and wherein the pattern of the colored resin layer is visible when viewed from a side of the substrate having the metal thin film layer and the colored resin layer.

The invention of claim 2 provides the thread according to claim 1, further comprising at least one metal thin film layer formed in a pattern of either character or figure or both on an opposite side of the substrate, and a colored resin layer patterned same as the metal thin film layer on the metal thin film layer, wherein, due to difference in light permeability between a region having the metal thin film layer and a region not having the metal thin film layer, a contrast is caused between the former region and the latter region when held to light, and wherein the pattern of the colored resin layer is visible when viewed from a side of the substrate having the metal thin film layer and the colored resin layer.

The invention of claim 3 provides the thread according to claim 2, wherein the patterns are the same between the one side and the opposite side of the substrate.

The invention of claim 4 provides the thread according to claim 2, wherein the patterns are different between the one side and the opposite side of the substrate.

The invention of claim 5 provides the thread according to claim 2, wherein the metal thin film layer formed on the one side of the substrate and the metal thin film layer formed on the opposite side are different in any of pattern, size, location and direction.

The invention of claim 6 provides the thread according to claim 2, wherein the colored patterns have the same color at least on one side of the substrate.

The invention of claim 7 provides the thread according to claim 2, wherein the colored patterns have different colors at least on one side of the substrate.

The invention of claim 8 provides the thread according to claim 2, wherein the colored patterns have the same color both on one side and opposite side of the substrate.

The invention of claim 9 provides the thread according to claim 2, wherein the colored patterns have different colors on one side and opposite side of the substrate, respectively.

The invention of claim 10 provides the thread according to claim 2, wherein the metal thin film layer and the corresponding colored resin layer patterned similarly as above are present in a plurality of sets, and the plurality of sets of patterns are arrayed in one row or more on the substrate.

The invention of claim 11 provides the thread according to claim 2, wherein the pattern forming character or figure is provided in correct direction when viewed from a side of the substrate having the metal thin film layer and the colored resin layer corresponding to the pattern.

The invention of claim 12 provides the thread according to claim 2, wherein the pattern forming character or figure is provided in laterally or vertically inverted direction when viewed from a side of the substrate having the metal thin film layer and the colored resin layer corresponding to the pattern.

The invention of claim 13 provides a method of manufacturing the thread according to claim 2, comprising:

forming the metal thin film layer by forming a thin film of metal on a surface of a web-like and light permeable substrate, forming the colored resin layer in a desired pattern by printing on the metal thin film layer, etching the metal thin film layer by using the patterned colored resin layer as an etching resistant mask, thereby forming the metal thin film layer and the colored resin layer overlaid in the same pattern, and cutting the substrate to the width of the thread.

The invention of claim 14 provides a method of manufacturing the thread according to claim 2, comprising:

forming the metal thin film layer by forming a thin film of metal on a surface of a strip-like and light permeable substrate, forming the colored resin layer in a desired pattern by printing on the metal thin film layer, and etching the metal thin film layer by using the patterned colored resin layer as an etching resistant mask, thereby forming the metal thin film layer and the colored resin layer overlaid in the same pattern.

The invention of claim 15 provides a counterfeit preventive paper comprising the thread according to claim 2 inserted into paper sheets to be made in the counterfeit preventive paper.

The invention of claim 16 provides a counterfeit preventive paper comprising the thread according to claim 2 inserted into the paper sheets so as not to be exposed on the surface of the counterfeit preventive paper, wherein the pattern of the colored resin layer is visually recognized when the surface of the counterfeit preventive paper is viewed on a side of the colored resin layer of the thread with reflected light.

The invention of claim 17 provides a counterfeit preventive printed material wherein a printed portion printed as a counterfeit preventive printed material is provided on the counterfeit preventive paper according to claim 15.

The invention of claim 18 provides a method of judging authenticity of the counterfeit preventive paper according to claim 15, wherein authenticity is judged by checking whether following conditions (a) and (b) can be recognized:

(a) when the colored resin layer can be recognized as the pattern by reflected light, if the paper is viewed from an opposite side with reflected light, the laterally or vertically inverted pattern of the recognized colored resin layer is hardly visible, and (b) if the paper is viewed with transmitted light while held to light, the pattern of the recognized colored resin layer is visible as a shadow.

The invention of claim 19 provides a method of judging authenticity of the counterfeit preventive printed material according to claim 17, wherein authenticity is judged by checking whether following conditions (c) and (d) can be recognized:

(c) when the colored resin layer can be recognized as the pattern by reflected light, if the paper is viewed from an opposite side with reflected light, the laterally or vertically inverted pattern of the recognized colored resin layer is hardly visible, and (d) if the paper is viewed with transmitted light while held to light, the pattern of the recognized colored resin layer is visible as a shadow.

The present invention is thus composed, and hence brings about the following effects.

That is, the thread obtained in the invention can be used in, as representative examples, counterfeit preventive paper (paper for obtaining counterfeit preventive printed material) or counterfeit preventive printed material. In the conventional threaded paper (or printed material), when viewed from one side (obverse side), only the image of the micro-character on one side (obverse side) of the thread is seen, and when viewed from opposite side (reverse side), the image of the micro-character of the thread is naturally seen only as inverted image, either laterally or vertically. At this time, the result is the same whether reflected light or transmitted light is used.

By contrast, in the (counterfeit preventive) paper or (counterfeit preventive) printed material according to the invention of the thread of claim 1 as a basis, the colored image of pattern of micro-character of the thread visually recognized from one side (for example, obverse side) is not visible (or hardly visible) by reflected light as viewed from the opposite side (for example, reverse side). It is hence contrary the expectation that something should be visible, and it may be expected to be useful as means for preventing counterfeit or an interesting idea for entertainment or plaything. This is because, when viewed from the opposite side, the metal thin film layer positioned at the observer's side reflects the light in the paper, and the patterned metal thin film layer and the colored layer appear to be nonexistent therein. In this case, when the paper or printed material is viewed with transmitted light while held to light, the shadow image of the micro-character can be recognized from either side.

By further modification, in the paper (for preventing counterfeit) or printed material (for preventing counterfeit) according to the invention of claim 2 (slightly different in configuration), when one side (e.g. obverse side) and opposite side (reverse side to obverse side) are viewed with reflected light, the colored image of micro-character of the thread can be seen in the same direction from both sides. When applied to typical examples, such as booklet type passport, bankbook or pocket notebook, the commercial value of these items may be enhanced, and a high counterfeit preventive effect is also expected.

When the thread is inserted in the paper so as to be partly exposed on the surface, the reflected light by a metal thin film layer existing on the opposite side of the thread may be seen directly without passing through the surface layer of the paper, and the existence of pattern of the metal thin film layer may be noticed in such a case. It is generally preferred to insert the thread so as to be entirely concealed in the paper in order to expect such effects.

In this case, the image of the micro-character is either the image (the former) seen from one side (e.g. obverse side) with reflected light, or the image (the latter) seen from opposite side (reverse side to obverse side) with reflected light, and when the paper or printed material is viewed with transmitted light while held to light, the former image and latter image may be seen as an overlapped image, which image is seen as a shadow.

When the positions of the two micro-characters are not overlapped to each other, and are same in size, shape, inclination, and color with each other, the observer may have an illusion of seeing actually the same image, and it may be fun or give an effect of making counterfeit difficult. On the other hand, when the positions of the two micro-characters are partly and/or wholly overlapped, and/or same in size, shape, inclination, and color with each other, or may be slightly different from each other, a different kind of fun may be given, and the counterfeit is also made difficult.

The thread obtained in the present invention may be applied in other purposes than counterfeit preventive paper. For example, in a similar method of manufacturing gold and silver yarns used in fabrication of kimono, that is, when the sewing yarn is manufactured by winding this thread spirally in the outer circumference direction of the twine, the counterfeit preventive sewing yarn is obtained. When this sewing yarn is sewn in a concealed portion of a bag of a famous brand or the like, the fake and genuine can be distinguished easily. When the sewing position in the bag is not visible or not obvious, it is hardly noticed as authenticity judging means.

DETAILED DESCRIPTION OF THE INVENTION

Preferred embodiments of the invention will be specifically described below while referring to the accompanying drawings.

Figure 1:
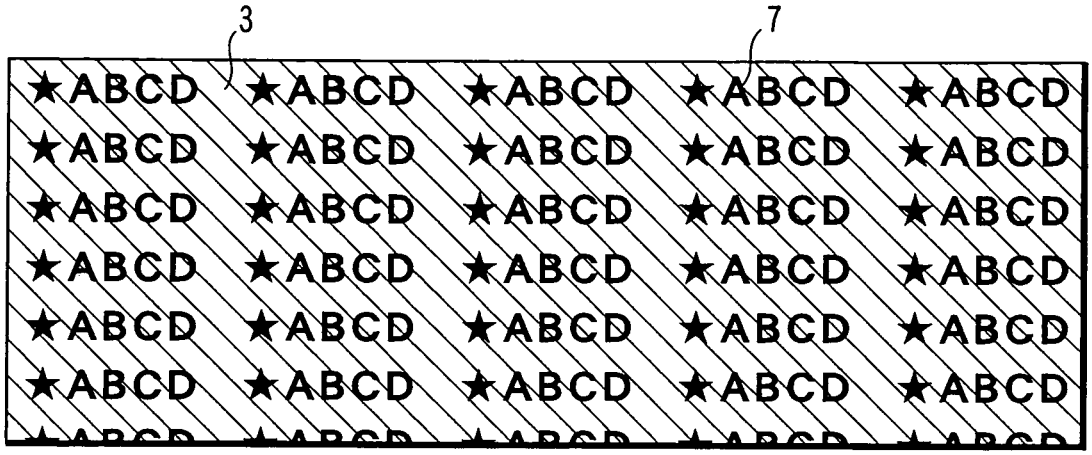
FIG. 1 is a front view of a material for manufacturing a thread of the invention, in which a metal deposition layer on a substrate and colored resin printed layer on the metal deposition layer are arranged in plural rows.
Figure 2:
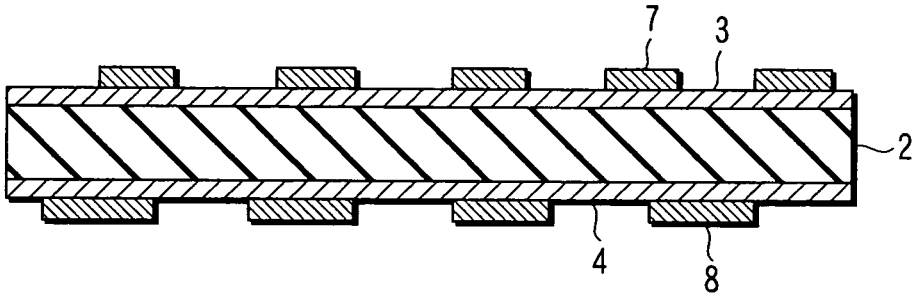
FIG. 2 is a partially magnified cross-sectional view of FIG. 1.

FIG. 1 is a front view, in which a colored resin printed layer (7) is formed on a metal deposition layer (3) formed on the surface of a substrate for manufacturing a thread (1) of the invention, and FIG. 2 is its partially magnified cross-sectional view, in which the metal deposition layer (3) is formed on the front side of the surface of the substrate (2), the colored resin printed layer (7) is applied thereon, and a colored resin printed layer (8) is formed on a metal deposition layer (4) not shown in FIG. 1 at its reverse side. These colored resin printed layers (7, 8) are printed as patterns of micro-characters.

Herein, the metal deposition layers (3, 4) are preferred examples of the metal thin film layers of the invention, and the metal is formed into a film by vacuum evaporation, which is preferred in the invention from the viewpoint of proper light shielding property, light reflectivity, ease of processing, and cost. The metal thin film layer of the invention may be alternatively formed by other proper deposition process if necessary. The colored resin printed layers (7, 8) are preferred examples of the colored resin layers of the invention, and specifically the ink mainly composed of coloring matter and resin is formed into a desired pattern by a proper printing process. By properly selecting the printing process, a desired pattern can be formed easily and precisely.

The colored printed resin layers (7, 8) may be in the same hue with each other or in different hues to each other.

In the case of patterning the metal deposition layers (3, 4) by etching, in order to use the colored resin printed layers (7, 8) as an etching resistant mask, the materials of the colored resin printed layers (7, 8) such as coloring matter and resin must be selected properly so as not to be etched easily by the etching solution. If the etching solution permeates into the interface of the metal deposition layers (3, 4) and the colored resin printed layers (7, 8), the patterning precision may be lowered. In order to prevent this inconvenience, therefore, it is desired to select properly the material or deposition technique excellent in adhesion between the metal position layers and the colored resin printed layers.

At this time, in the colored resin printed layers (7, 8), ultraviolet fluorescent color developing agent may be used together. It is also possible to use dye or pigment developing color by ultraviolet ray or develop visible color by natural light.

The colored resin printed layers (7, 8) may be formed by offset printing, gravure printing, screen printing, flexographic printing or inkjet printing. Usually this printing thickness is about 0.5 μm to 3 μm. The size of micro-characters is usually about 2 to 10 points.

Figure 3:
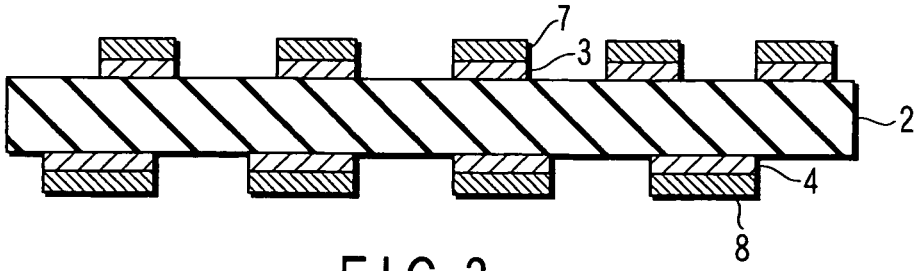
FIG. 3 is a partially magnified cross-sectional view showing the substrate in FIG. 2 subjected to demetallizing process.

The substrate is immersed in aqueous alkaline solution or aqueous acidic solution (that is, the substrate is subjected to demetallizing process), the metal deposition layer is dissolved in other portion than the colored resin printed layers (7, 8) as shown in FIG. 3, and the material is slit by a micro-slitter, and taken on a bobbin, thereby obtaining the thread of the invention.

For easily understanding the invention, it is supposed herein that the metal deposition layer is an aluminum deposition layer, that the obverse colored resin printed layer (7) is colored in red, and that the reverse colored resin printed layer (8) is colored in blue.

In FIG. 3, since the red colored printed resin layer (7) is transparent, the light entering this layer is reflected by the surface of the aluminum deposition layer (3) which is in contact with this resin layer, and is emitted to the surface. At this time, a micro-character is seen with a hue of "red-silver color" having the silver color of the aluminum deposition layer added to the red color. For a similar reason, on the reverse side, a micro-character of "blue-silver color" is seen.

Figure 4:
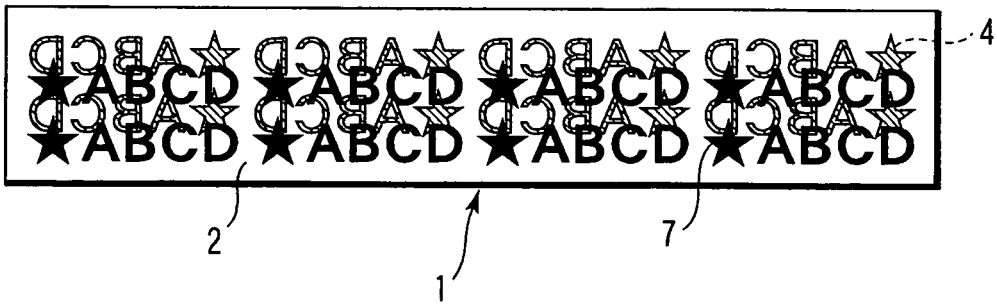
FIG. 4 is a front view of an example of the thread of the invention.

At this time, if the substrate (2) is transparent, as shown in FIG. 4, the micro-character (4) formed on the reverse side is seen as a laterally inverted character, but its hue is a silver color of the aluminum deposition layer.

Figure 5:
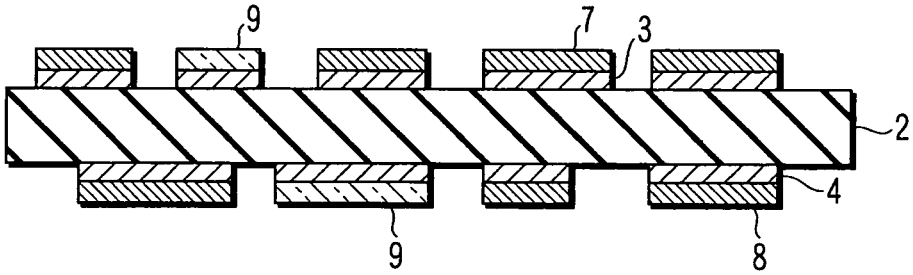
FIG. 5 is a partially magnified cross-sectional view of another example of the thread of the invention.

As shown in FIG. 5, instead of forming the colored resin printed layers (7, 8) on the entire surface of the substrate, a partially non-colored resin printed layer (9) may be provided. In this case, the hue of the metal deposition layer, i.e., a silver color, for example, in vapor evaporated meal aluminum, is visually recognized from the surface of the thread. The resin used in the non-colored resin printed layer (9) may be the same resin as that used in the colored resin printed layers (7, 8).

FIGS. 6 to 9 are front views showing various examples of the thread of the present invention.

Figure 6:
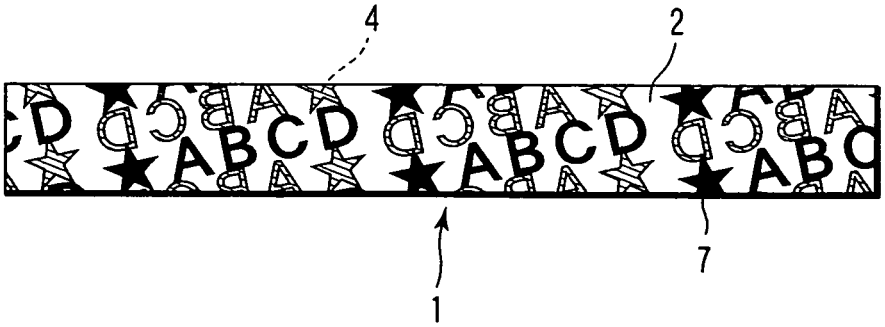
FIG. 6 is a front view of another example of the thread of the invention.

In the thread (1) shown in FIG. 6, the colored resin printed layer (7) disposed for the demetallizing process is arrayed at a certain angle relative to the thread feeding direction. Although not shown in the drawing, the colored resin printed layer disposed for the demetallizing process on the reverse side is similarly arrayed at a certain angle relative to the thread feeding direction, and the metal deposition layer (4) can be seen through a transparent substrate.

Figure 7:
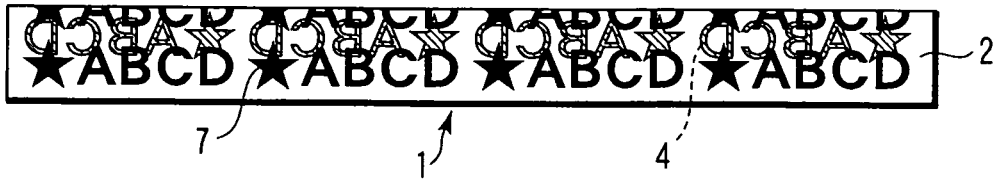
FIG. 7 is a front view of another example of the thread of the invention.

In the thread (1) shown in FIG. 7, the colored resin printed layer (7) disposed for the demetallizing process is arrayed at least in one row so as not to be cut vertically in the thread width direction. Although not shown in the drawing, the colored resin printed layer disposed for the demetallizing process on the reverse side is similarly arrayed at least in one row so as not to be cut vertically in the thread width direction, and the metal deposition layer (4) can be seen through a transparent substrate.

Figure 8:
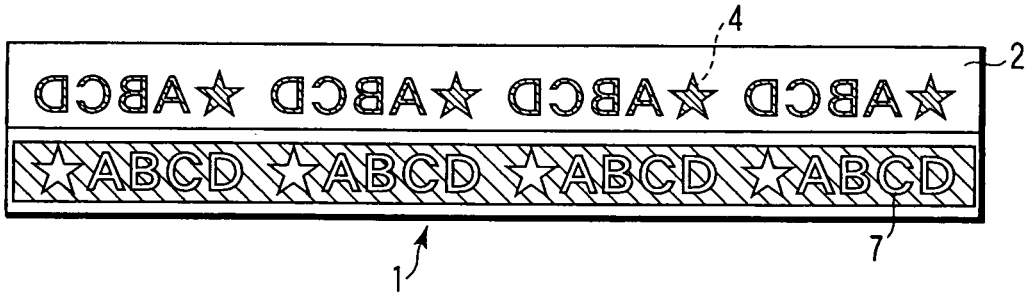
FIG. 8 is a front view of another example of the thread of the invention.

In the thread (1) shown in FIG. 8, one row of the colored resin printed layer (7) disposed for the demetallizing process is arrayed in negative type. Although not shown in the drawing, similarly, one row of the colored resin printed layer disposed for the demetallizing process on the reverse side is arrayed in negative type, and the metal deposition layer (4) can be seen through a transparent substrate.

Figure 9:
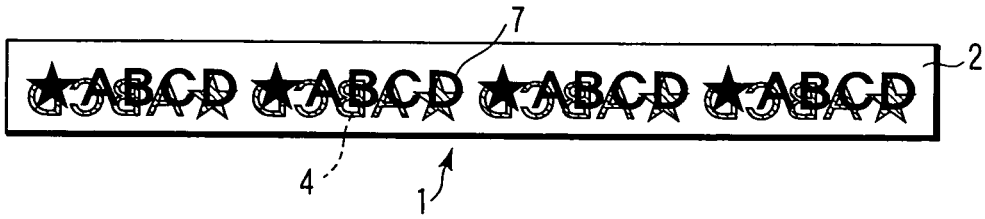
FIG. 9 is a front view of another example of the thread of the invention.

In the thread (1) shown in FIG. 9, one row of the colored resin printed layer (7) disposed for the demetallizing process is arrayed in central position. Although not shown in the drawing, similarly, one row of the colored resin printed layer disposed for the demetallizing process on the reverse side is arrayed in central position, and the metal deposition layer (4) can be seen through a transparent substrate.

Figure 10:
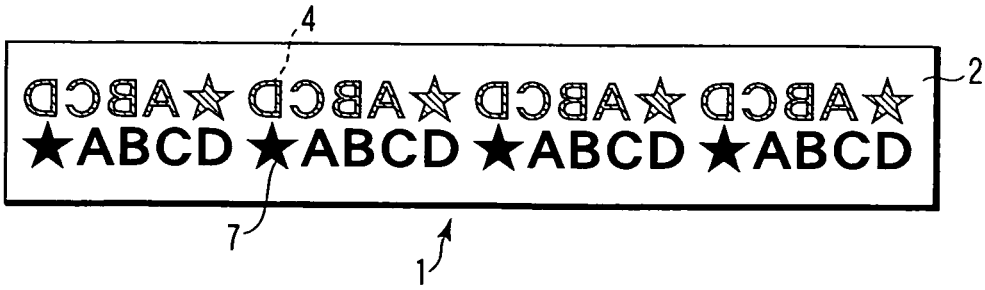
FIG. 10 is a front view of another example of the thread of the invention.

Moreover, in the thread (1) shown in FIG. 10, two rows of the colored resin printed layer (7) disposed for the demetallizing process are arrayed in parallel so as not to be cut vertically in the thread width direction. Although not shown in the drawing, similarly, two rows of the colored resin printed layer (7) disposed for the demetallizing process on the reverse side are arrayed in parallel so as not to be cut vertically in the thread width direction, and the metal deposition layer (4) can be seen through a transparent substrate.

In the invention, in addition to the above examples of the thread, other examples of the threads are also included in the scope of the invention. The observe and reverse sides may be formed in the same design, the obverse and reverse sides may be formed in different designs, the obverse and reverse sides may be formed in the same color, the obverse and reverse sides may be formed in different colors, the micro-characters formed on the obverse side may be formed in different colors, the micro-characters formed on the reverse side may be formed in different colors, and these examples may be properly combined.

The micro-characters may either positive type or negative type as shown in FIG. 8.

Figure 11:
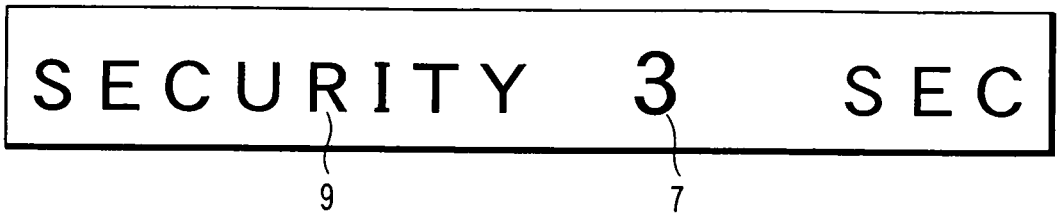
FIG. 11 is a front view of another example of the thread of the invention.
Figure 12:
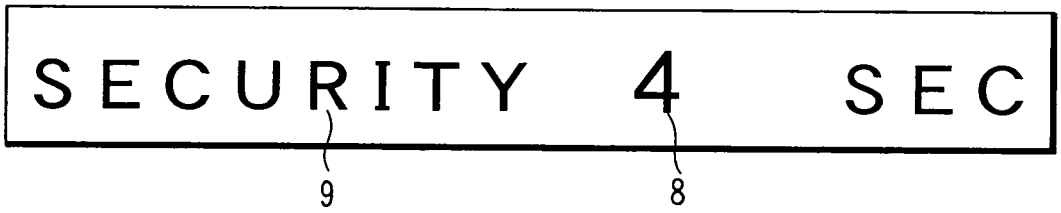
FIG. 12 is a view showing the reverse side of the thread of FIG. 11.

In the thread shown in FIG. 11, the micro-character "SECURITY" is not colored, but appears to be silver color, and the micro-character "3" appears to be colored in red. FIG. 12 shows the reverse side of the thread in FIG. 11, in which the micro-character "SECURITY" is not colored, but appears to be silver color, and the micro-character "4" appears to be colored in blue.

In FIGS. 11 and 12, the micro-characters formed on the opposite side through the transparent substrate are actually recognized as reverse characters, but they are omitted for the ease of understanding.

Figure 13:
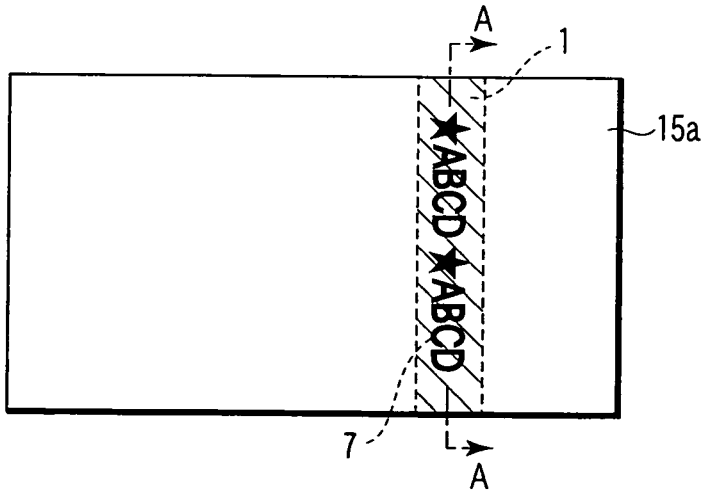
FIG. 13 is a front view of an example of counterfeit preventive paper of the invention.
Figure 14:
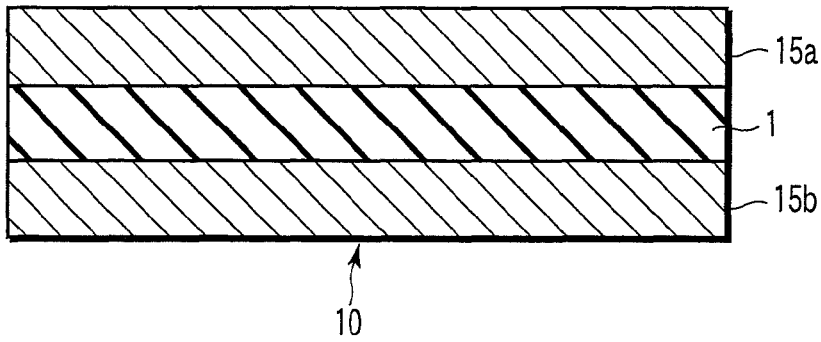
FIG. 14 is a cross-sectional view along line A-A in FIG. 13.

FIG. 13 is a plan view showing an example of counterfeit preventive paper (10) of the invention, and FIG. 14 is a cross-sectional view along line A-A in FIG. 13. The shown counterfeit preventive paper (10) includes two layers, i.e., a paper layer (15*a*) and a paper layer (15*b*), and the thread (1) is inserted between these paper layers (15*a*, 15*b*).

Figure 15:
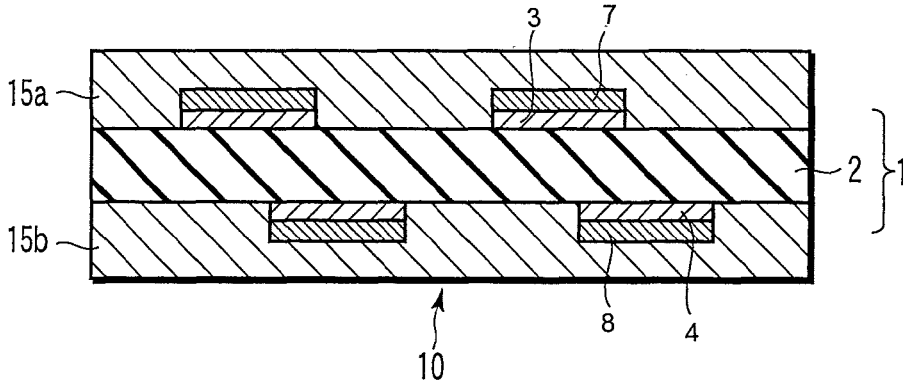
FIG. 15 is a partially magnified cross-sectional view of an example of counterfeit preventive paper of the invention.
Figure 16:
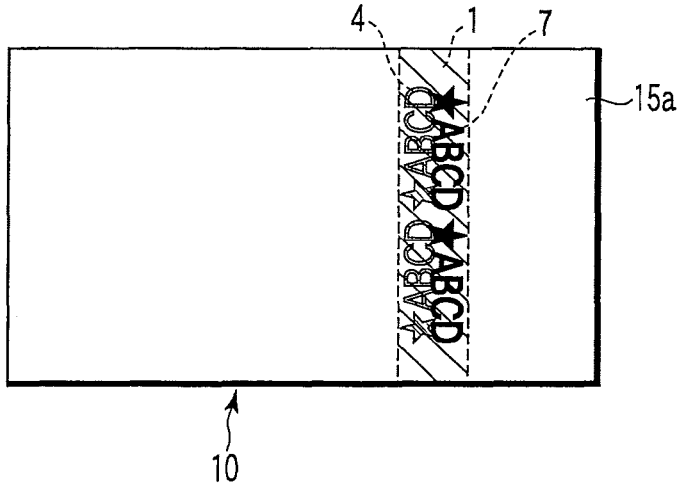
FIG. 16 is a front view of an example of the counterfeit preventive paper in FIG. 15.

FIG. 15 is a partly magnified cross-sectional view of the counterfeit preventive paper (10) showing how the thread (1) of the invention is seen when inserted between these paper layers (15*a*, 15*b*). FIG. 16 is its plan view. In this state, when the thread (1) is seen from the obverse side of the paper, the colored resin printed layer (7) of the obverse side is seen as a pattern of red micro-character. The thread alone is viewed in red-silver color as described above, but the thread inserted between the paper layers is seen from the paper surface with the silver color is lost, and is hence recognized as red color. Similarly, from the reverse side of the paper, a pattern of blue micro-character can be seen.

As mentioned above, the micro-character formed on the reverse side is recognized as laterally inverted character when seen through a film, but its hue is silver color of the aluminum deposition layer. If this light appears on the paper surface, it is manufactured so as not to be distinguished from the paper color, and thus it is not viewed as a pattern of micro-character.

The thread (1) of the present invention will be more specifically described below.

The substrate (2) is a semi-synthesized or synthesized resin film of cellophane, polypropylene, polyethylene terephthalate, polybutylene terephthalate, polyacetal, polyphenylene ether, liquid crystal polymer, polyvinyl chloride, polyester, polyamide, polycarbonate, ethyl polymethacrylate, polystyrene or the like, which may be used either as a single layer or as a complex. It is further preferred to select a proper material having properties of not being dissolved or softened in the drying zone of a paper machine, and not being sticky usually in a temperature range of 90 to 110° C. The thickness of the substrate is desired to be in the range of 5 μm to 25 μm because processing is difficult if too thin, or the paper thickness is partially increased and various problems are caused when a thread is inserted between paper layers if too thick.

Preferably, the substrate (2) should not be visually recognized from appearance in a state of counterfeit preventive paper or counterfeit preventive printed material with the thread inserted between paper layers. The substrate satisfying this condition includes a colorless substrate. A very pale tinted substrate may also be used as long as the object of the invention is achieved. In the invention, a typical example is a transparent polyester film high in physical strength and stable chemically.

Further, a sand-blasted translucent substrate is also used preferably when the paper color is white or nearly white because the existence of the thread inserted between the paper layers cannot be visually recognized under reflected light. In order that the reverse character may be seen from the obverse side when viewed with transmitted light, the substrate is required to be transparent. In the invention, being transparent does not always mean 100% transparency, but this percentage may be slightly lower as long as the object can be achieved. That is, the transparency may be adjusted properly because it is related to the color of the ink printed around the thread of the paper or printed material.

The substrate (2) preferably has a property of absorbing ultraviolet rays. This is because, as explained later, as the means for judging the front and back of the thread, when the adhesive is used together with dye or pigment emitting light by irradiation with ultraviolet ray to judge the front and back of the thread by emitting ultraviolet ray to the thread during making of paper, if the substrate (2) does not absorb ultraviolet ray, the ultraviolet ray transmits through the substrate between the metal deposition layers removed by demetallizing, and the both sides of the thread emit light and are viewed, thereby making it difficult to judge the front and back of the thread.

To provide the substrate (2) with such property, any known means may be employed, that is, an ultraviolet absorbent is kneaded at the time of manufacture of the substrate, or a coating layer for absorbing ultraviolet ray is provided on the surface of the substrate. Examples of the ultraviolet absorbent include benzophenone series, triazine series, triazole series, salicylic series, hydroquinone series, amine series, microparticulate metal oxide such as zinc oxide and titanium oxide, and other known ultraviolet absorbents. The content of the ultraviolet adsorbent is usually about 0.01 to 5 mass % of the substrate.

The method of forming the micro-character on the substrate (2) includes the demetallizing process. The demetallizing process is a well-known method (see, for example, Jpn. Pat. Appln. KOKAI Publication No. 2005-513585), and for example, metal aluminum is vacuum evaporated on the substrate (2), the micro-character is printed with ink comprising anti-alkali or anti-acid resin and a coloring agent of dye or pigment such as scarlet, indigo, yellow, black, or white alone or as mixture added thereto, thereby forming colored resin printed layers (7, 8), after which the deposition layer such as aluminum is washed away in other portion than the printed portion by using aqueous alkaline or acidic solution. By such process, the deposition layer of aluminum or the like is left in the printed portion, and the base layer (2) is exposed in other area than the printed portion. The metal used in the deposition layer is typically aluminum as explained herein, and also includes tin, zinc, iron, nickel, chromium, cobalt or other metal, which may be used either alone or in mixture. In particular, when at least one of the rows of micro-characters is formed as a deposition film of a magnetic material such as nickel-cobalt, the magnetic information can be utilized as counterfeit preventive means. A proper thickness of the metal deposition layer is usually about 250 to 1,000 angstroms.

After processing the substrate (2) in this manner, an adhesive is applied to one side or both sides as required. The adhesive may be any known adhesive softened or dissolved in a dryer of a paper machine, and having a performance of firmly adhering to the paper. The adhesive layer is formed by using polyvinyl acetate resin series, polyvinyl chloride resin series, polyester resin series, ester polyacrylate resin series, ethylene-vinyl acetate copolymer resin series, polyvinyl alcohol resin series, or other known adhesive, as water-base or solvent-base paint, and applying the paint on the surface of the substrate by using a roll coater, a gravure coater, or other known coating machine. The coating amount is usually 0.1 to 10 g/m$^2$ (converted to dry mass).

In the threaded paper of the type having the thread buried between paper layers, the coating amount of adhesive may be small, but in the case of the windowed threaded paper, the coating amount of adhesive should be increased. The adhesive may be properly blended with necessary additives, such as blocking preventive agent, lubricant, coloring agent, or fluorescent coloring agent. As mentioned above, when it is necessary to judge the front and back of the thread, a substrate capable of absorbing ultraviolet ray is used as the substrate, and the fluorescent coloring agent is added to the adhesive, which is then applied to one side only, thereby manufacturing the thread. In this manner, by irradiation with ultraviolet ray, the front and back of the thread can be easily judged by presence or absence of light emission of the thread.

By slitting in a specified width according to a common procedure using a micro-slitter device, the thread of the invention is completed. The thread width is usually 0.5 mm to 10 mm. The micro-characters formed in the thread must be formed so that pattern of correct character or correct figure of one row or more should be visually recognized.

The methods of obtaining the demetallized raw substrate are as follows: forming the colored resin printed layer (7) first on the obverse side of the substrate having metals preliminarily vacuum evaporated on the both sides, and then forming the colored resin printed layer (8) on the reverse side, followed by demetallizing; or, reversely, forming the colored resin printed layer (8) first on the reverse side of the substrate having metals preliminarily deposited on the both sides, and then forming the colored resin printed layer (7) on the obverse side, followed by demetallizing.

Alternatively, the same effect is obtained by forming the colored resin printed layer (7) first on the surface of the substrate having metals preliminarily deposited on one side, followed by demetallizing, and then forming the colored resin printed layer (8) on the opposite surface, followed by demetallizing.

An example of a method of manufacturing the counterfeit preventive paper (10) of the invention will be explained.

[Preparation of Paper Stock]

First, paper making pulps are provided, such as needle-leaf bleached kraft pulp (NBKP), large-leaf bleached kraft pulp (LBKP), needle-leaf bleached sulfite pulp (NBSP), or thermomechanical pulp (TMP), which are beaten and processed by using a beater or a discrifiner, and the paper stock is prepared by further adding clay, kaolin, calcium carbonate, titanium dioxide, aluminum hydroxide, or other fillers, or paper tenacity intensifier, sizing agent, yield improver, defoaming agent, coloring dye, coloring pigment, fluorescent bleach, or fixing agent, properly as required.

[Manufacture of Counterfeit Preventive Paper]

The counterfeit preventive paper of the invention can be manufactured by a common procedure. As mentioned above, roughly there are two types of threaded paper. In one type, the thread is formed inside of the paper, and is not exposed to the paper surface, and in the other type, part of the thread is intermittently exposed to the paper surface, which is known as "windowed threaded paper". The counterfeit preventive paper of the invention may be applied in either type, but the feature of the thread of the invention is most exhibited in the windowed threaded paper.

The methods of manufacturing the former paper include, as mentioned above: a method of using a Fourdrinier paper machine, putting a nozzle into flow of a paper stock in its slice section, letting out the thread while pouring water into the nozzle, and inserting the thread into paper sheets formed in a manufacturing mesh (see, for example, patent document 1); a method of disposing a thread insertion device in the paper stock flowing out from the flow box of the Fourdrinier paper machine, and inserting the thread while the thread is kept free from contact with the paper stock by an air stream (see, for example, patent document 2); and a method of using a cylinder paper machine having two or more layers, making two or more paper layers together, sending out the thread between paper layers by using a feed tube having undulations in its inner wall, and inserting the thread between the paper layers (see, for example, patent document 3). In the invention, of course, any other method may be employed.

Figure 17:
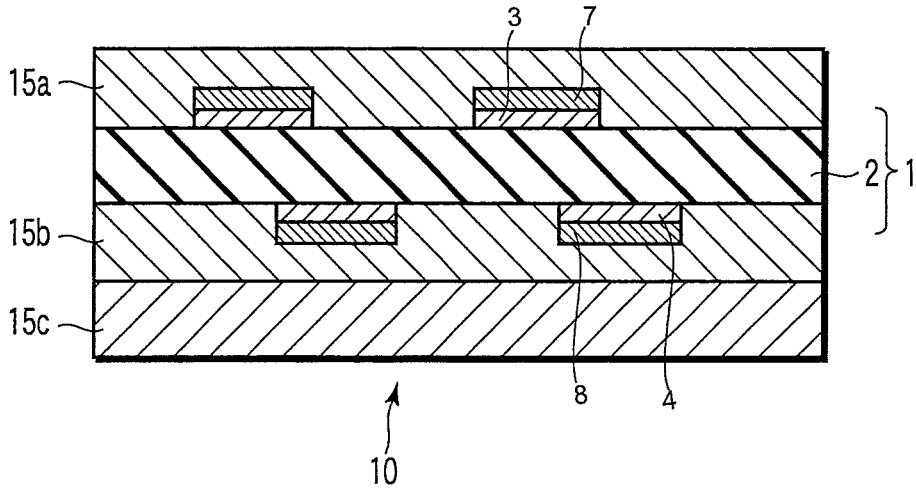
FIG. 17 is a partially magnified cross-sectional view of an example of counterfeit preventive paper of the invention.

FIG. 17 is an example of manufacturing the counterfeit preventive paper of the invention, showing a partially magnified cross-sectional view of three-layered paper manufactured by using a three-tank cylinder paper machine. More specifically, when making three layers together, i.e., paper layers 15*a*, 15*b*, 15*c*, the thread of the invention is inserted between the paper layers 15*a* and 15*b*. In this example, if the colored resin printed layer (7) (of the obverse side) and the colored resin printed layer (8) (of the reverse side) are identical, when viewed from the obverse side of the paper, that is, from the paper layer 15*a* side, the micro-character formed in the thread appears to be higher in contrast than when viewed from the reverse side of the paper, that is, from the paper layer 15*c* side. If this is a problem, the density of the colored resin printed layer (7) (of the obverse side) should be set lower than the density of the colored resin printed layer (8) (of the reverse side). In this case, it is required to form the thread into the paper while controlling the front and back of the thread, but this control is realized by the method mentioned above.

The methods of manufacturing the latter "windowed threaded paper" include, as mentioned above: a belt mechanism having a thread groove at the leading end of a convex part of a guide having concave and convex parts is buried in paper stock suspended solution on a wire, and the threaded paper is made (see, for example, patent document 4); an undulated mesh is used as an upper mesh of a cylinder paper machine, the thread is inserted while contacting with concave and convex parts of the mesh surface, and the thread is inserted in the windowed portions (see, for example, patent document 5); and a compressed air nozzle is built in a rotary drum on the wire of the Fourdrinier paper machine, the slurry on the thread preliminarily inserted into the paper sheets is blown out intermittently by compressed air, and the thread is exposed (see, for example, patent document 6). In the invention, of course, any other method may be employed.

In the paper making process, polyacrylamide resin, starch, or polyvinyl alcohol may be applied on the paper surface. As required, further, the surface smoothness may be improved by machine calender process or super-calender process.

In the case of windowed threaded paper, when inserting the thread having colored printed layers (7, 8) on both sides as shown in FIG. 3, for example, by passing the light from the reverse side similarly in the window portion, the metal deposition plane (4) of reverse character is visible.

For example, in the counterfeit preventive paper with the thread having the micro-character appearing to be red-silver color formed at one side, and having the micro-character appearing to be blue-silver color formed at the opposite side inserted between paper layers, the paper thickness and paper making process should be adjusted so as to obtain the following effects. The light entering from the paper obverse side is reflected by the surface of the printed resin layer (7) colored in red, and the red micro-character can be recognized on the paper surface. For the same reason, the blue micro-character can be recognized on the reverse side of the paper. The light entering from the paper surface (obverse side) also enters inside of the thread, and reaches up to the blue micro-character forming side, that is, the metal deposition plane. The incoming light is reflected by the deposition plane, and is partly emitted from the paper surface, but since this light has the hue of the deposition plane, that is, silver color, and can be hardly distinguished from the hue of the reflected light of the paper surface. The most effective means for achieving this object is adjustment of basis weight of paper, selection of type of filler used together with the paper stock, and adjustment of adding amount thereof. The basis weight of paper is usually 50 to 150 g/m$^2$.

To judge authenticity of the counterfeit preventive paper of the invention thus obtained, as shown in FIGS. 15 and 16, for example, following methods are used: as viewed from the surface, when the colored resin printed layer (7) is recognized as *ABCD with the reflected light, if the paper is viewed from the reverse side with reflected light, the laterally inverted character (not shown) of *ABCD of the resin printed layer (7) visible from the surface is hardly visible, or if the paper is viewed with transmitted light while held to light, the colored resin printed layer (7) is recognized as shadow of *ABCD, then it means the paper is false.

Specific examples of the invention will be described below.

Example 1

Manufacture of Thread

The substrate used was a rolled transparent polyester film of 12 μm in thickness (manufactured by Toray), and metal aluminum was deposited in 50 nm (nanometers) each on both sides of the substrate by a common procedure using a vacuum evaporation apparatus. On one side of the substrate, a colored resin printed layer (micro-character printed layer) was formed with alkali-resistant resin ink colored in blue using a gravure printing machine (containing 100 parts by mass of acrylic resin for demetallizing, and 20 parts by mass of blue dye: oleozole blue (manufactured by Sumitomo Chemical)). On the opposite side of the substrate, a colored resin printed layer (micro-character printed layer) was formed with alkali-resistant resin ink colored in red (containing 100 parts by mass of acrylic resin for demetallizing, and 15 parts by mass of red dye: oleozole fast red (manufactured by Sumitomo Chemical)).

The micro-characters were composed of "*ABCD", the size thereof was 2.5 points (American points, 1 point is about 0.35 mm), the interval between characters was 0.4 mm, and the interval between character lines was 0.8 mm. The character line was printed while inclined 18 degrees to the feeding direction of the substrate as shown in FIG. 5.

By common procedures, the substrate was subjected to demetallizing with aqueous aluminum hydroxide solution, washed with water, dried, and taken up on a roll.

Further on one side of the substrate, an ethylene-vinyl acetate-based thermosensitive adhesive of system was applied in a thickness of 1.5 μm using a gravure coater, thereby forming an adhesive layer. A thread of 2 mm in width was formed using a micro-slitter. This thread was taken up on a bobbin.

Example 2

Manufacture of Thread

The substrate used was a rolled transparent polyester film of 12 μm in thickness (manufactured by Toray), and metal aluminum was deposited in 40 nm (nanometers) on one side of the film by a common procedure using a vacuum evaporation apparatus. On the deposited surface, a colored resin printed layer (micro-character printed layer) was formed with alkali-resistant resin ink colored in blue using a gravure printing machine (containing 100 parts by mass of acrylic resin for demetallizing, and 20 parts by mass of blue dye: oleozole blue (manufactured by Sumitomo Chemical)).

By common procedures, the substrate was subjected to demetallizing with aqueous aluminum hydroxide solution, washed with water, dried, and taken up on a roll.

On the opposite side of the substrate, metal aluminum was deposited in a thickness of 40 nm (nanometers) by a common procedure using a vacuum evaporation apparatus, and a colored resin printed layer (micro-character printed layer) was formed with alkali-resistant resin ink colored in red (containing 100 parts by mass of acrylic resin for demetallizing, and 15 parts by mass of red dye: oleozole fast red (manufactured by Sumitomo Chemical)).

By common procedures, the substrate was subjected to demetallizing with aqueous aluminum hydroxide solution, washed with water, dried, and taken up on a roll.

The micro-characters were composed of "*ABCD" as shown in FIG. 10, the size thereof was 2.5 points (American points, 1 point is about 0.35 mm), the interval between characters was 0.4 mm, and the interval between character lines was 0.325 mm. The character lines were arrayed so that the obverse character line and reverse character line may not overlap each other when viewed with transmitted light.

On one surface of the substrate, an ultraviolet absorbing layer was further formed in a thickness of 2 μm with a mixture of benzophenone-based ultraviolet absorbent and self-crosslinking polyester acrylate resin.

Further on this side, an ethylene-vinyl acetate-based thermosensitive adhesive added with oxazole fluorescent coloring agent (using 2.5 mass % of the adhesive) was applied in a thickness of 2 μm, thereby forming an adhesive layer. A thread of 2.4 mm in width was formed using a micro-slitter. At this time, as shown in FIG. 10, by slitting the substrate under controlling the micro-slitter so that the micro-character may not be cut off in the upper portion or lower portion, and the thread was taken up on a bobbin.

Example 3

Manufacture of Counterfeit Preventive Paper

<Preparation of Paper Stock>

NBKP by 25 parts by mass, and LBKP by 75 parts by mass were beaten in freeness 350 ml CSF, and 10 parts by mass of clay, 5 parts by mass of titanium dioxide, 0.4 part by mass of paper tenacity intensifier: Polystron (manufactured by Arakawa Chemical), 1.0 part by mass of sizing agent: Size Pine E (manufactured by Arakawa Chemical), and a proper amount of sulfuric acid band were properly added, thereby preparing the paper stock.

<Manufacture of Counterfeit Preventive Paper>

In a first tank and a second tank of a two-tank cylinder paper machine, paper sheets with a basis weight of 45 g/m$^2$ were manufactured individually, and when making the both paper sheets, the thread manufactured in Example 1 was inserted between the paper layers. After drying by a common procedure, the counterfeit preventive paper was manufactured. When the obtained counterfeit preventive paper was viewed with reflected light, only the blue micro-characters were visible on one side, and only the red micro-characters were visible on the opposite side.

Example 4

Manufacture of Counterfeit Preventive Paper

The counterfeit preventive paper was manufactured in the same procedure as in Example 3 except that the thread was changed to the thread obtained in Example 2. Immediately after the thread was inserted between paper layers, the paper was irradiated with ultraviolet light using an ultraviolet fluorescent lamp, and the front or back of the thread was judged by detecting whether the thread developed ultraviolet fluorescent color or not, and when the thread was inverted, the thread was inserted correctly so that the normal side could be formed. When the obtained counterfeit preventive paper was viewed with reflected light, only the blue micro-characters were visible on one side, and only the red micro-characters were visible on the opposite side.

Example 5

Manufacture of Counterfeit Preventive Printed Material

Figure 18:
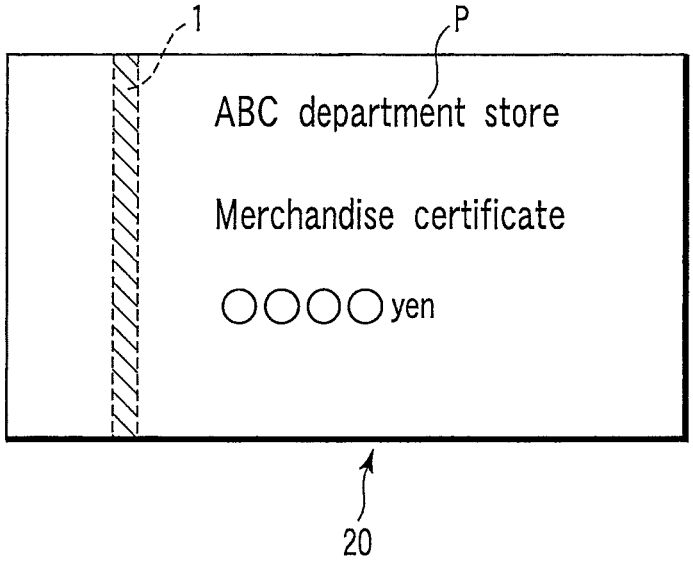
FIG. 18 is a front view of an example of a counterfeit preventive printed material of the invention.

Using the counterfeit preventive paper manufactured in Example 3, pattern printing portions (P) of the merchandise certificate shown in FIG. 18 were printed, thereby manufacturing a counterfeit preventive printed material (20).

Example 6

Manufacture of Counterfeit Preventive Printed Material

Using the counterfeit preventive paper manufactured in Example 4, pattern printing portions (P) of the merchandise certificate shown in FIG. 18 were printed, thereby manufacturing a counterfeit preventive printed material (20).

The counterfeit preventive printed materials (20) of Example 5 and Example 6 were viewed from the obverse side with reflected light, the colored resin printed layer (7) of the inserted thread (1) was recognized by normal characters "*ABCD", the metal deposition layer (4) was vaguely recognized by laterally inverted characters through the transparent substrate (2), and when viewed from the reverse side with reflected light, the colored resin printed layer (8) was recognized by normal character "*ABCD", the metal deposition layer (3) was vaguely recognized by laterally inverted characters through the transparent substrate (2), and therefore it was judged to be genuine counterfeit preventive printed material (20).

The thread of the invention having such features demands extremely advanced technology in its manufacture, and is preferably applied in sewing yarns and others for the purpose of prevention of counterfeit. The counterfeit preventive paper having inserted therein the thread of the invention is preferably used in banknotes, merchandise certificates, checkbooks, stocks, bonds, cards, various tickets, confidential documents, passports, identification cards and others.

In particular, in the constitution of the thread shown in FIG. 5, when the thread having a numeral as shown in FIGS. 11 and 12 is inserted into the paper, and the numeral is used to indicate the page number of a passport booklet, an extremely advanced technology is demanded in manufacture of paper or booklet, and thus the counterfeit preventive performance is dramatically enhanced.

When the numeral is matched with the par value of merchandise certificate or the like, the counterfeit preventive performance is enhanced outstandingly.

What is claimed is:

1. A counterfeit preventive paper, comprising:

paper sheets to be made in the counterfeit preventive paper; and a thread inserted into the paper sheets so as not to be directly viewed from either surface of the counterfeit preventive paper, the thread comprising a string-like and light permeable substrate having front and back sides, at least one metal thin film layer formed in patterns of either character or figure or both on both sides of the substrate, and a colored resin layer on the exterior of the metal thin film layer formed in patterns that are patterned same as the metal thin film layer, the patterns made of the metal thin film layer and the patterns of the colored resin layer formed thereon being separated from each other, wherein the paper satisfies the following conditions (a) and (b):

(a) when the colored resin layer can be recognized as the pattern by reflected light, if the paper is viewed from an opposite side with reflected light, the laterally or vertically inverted pattern of the recognized colored resin layer is hardly visible, and (b) if the paper is viewed with transmitted light while held to light, the pattern of the recognized colored resin layer is visible as a shadow.

2. A counterfeit preventive printed material comprising:

the counterfeit preventive paper according to claim 1, and a printed portion printed as a counterfeit preventive printed material is provided on the counterfeit preventive paper.

* * * * *